US010790084B2

(12) United States Patent
Kajiya et al.

(10) Patent No.: US 10,790,084 B2
(45) Date of Patent: Sep. 29, 2020

(54) MULTI-PHASE IRON-CORE REACTOR HAVING FUNCTION OF CHANGING MAGNITUDE OF INDUCTANCE

(71) Applicant: FANUC CORPORATION, Yamanashi (JP)

(72) Inventors: Takafumi Kajiya, Yamanashi (JP); Hisashi Maeda, Yamanashi (JP)

(73) Assignee: Fanuc Corporation, Yamanashi (JP)

( * ) Notice: Subject to any disclaimer, the term of this patent is extended or adjusted under 35 U.S.C. 154(b) by 374 days.

(21) Appl. No.: 15/879,845

(22) Filed: Jan. 25, 2018

(65) Prior Publication Data

US 2018/0218833 A1 Aug. 2, 2018

(30) Foreign Application Priority Data

Jan. 30, 2017 (JP) ..... 2017-014098

(51) Int. Cl.
*H01F 27/30* (2006.01)
*H01F 29/10* (2006.01)
*H01F 27/245* (2006.01)

(52) U.S. Cl.
CPC ..... *H01F 29/10* (2013.01); *H01F 27/245* (2013.01); *H01F 27/30* (2013.01)

(58) Field of Classification Search
CPC ..... H01F 27/00–40
USPC ..... 336/65, 83, 170–173, 178, 212–215, 336/233–234
See application file for complete search history.

(56) References Cited

U.S. PATENT DOCUMENTS

| | | | | |
|---|---|---|---|---|
| 2,406,704 | A * | 8/1946 | Mossay | H01F 30/12 336/5 |
| 8,013,703 | B2 | 9/2011 | Hashino et al. | |
| 8,653,931 | B2 * | 2/2014 | Xu | H02P 9/02 336/234 |
| 10,008,322 | B2 | 6/2018 | Bhide et al. | |
| 10,141,102 | B2 | 11/2018 | Inaba et al. | |
| 10,199,155 | B2 | 2/2019 | Ishigaki et al. | |
| 2012/0106210 | A1 | 5/2012 | Xu et al. | |
| 2013/0187741 | A1 | 7/2013 | Goodrich et al. | |

FOREIGN PATENT DOCUMENTS

| | | | |
|---|---|---|---|
| DE | 1513862 | A1 | 4/1969 |
| GB | 1415209 | A | 11/1975 |
| JP | S32009349 | Y | 8/1957 |
| JP | S4943123 | A | 4/1974 |
| JP | S50026061 | A | 3/1975 |
| JP | S56101725 | A | 8/1981 |
| JP | S56106419 | U1 | 8/1986 |
| JP | S61256708 | A | 11/1986 |
| JP | S62209812 | A | 9/1987 |
| JP | H03502279 | A | 5/1991 |
| JP | H05109547 | A | 4/1993 |
| JP | 2001509962 | A | 7/2001 |
| JP | 2007173700 | A | 7/2007 |

(Continued)

*Primary Examiner* — Tuyen T Nguyen
(74) *Attorney, Agent, or Firm* — RatnerPrestia

(57) ABSTRACT

A multi-phase iron-core reactor has an iron core and windings. The iron core includes an outer iron core and an inner iron core. The outer iron core has teeth on which the N-phase windings are wound. The inner iron core faces the teeth through gaps, and has a shape so as to be able to provide at least two gap sizes in a selective manner.

6 Claims, 8 Drawing Sheets

(56) References Cited

FOREIGN PATENT DOCUMENTS

| | | | |
|---|---|---|---|
| JP | 2007-300700 | | 11/2007 |
| JP | 2008177500 | A | 7/2008 |
| JP | 2009170620 | A | 7/2009 |
| JP | 2009194957 | A | 8/2009 |
| JP | 2010252539 | A | 11/2010 |
| JP | 2013-074084 | | 4/2013 |
| JP | 2015159657 | A | 9/2015 |
| JP | 2016122760 | A | 7/2016 |
| JP | 2016122830 | A | 7/2016 |
| JP | 6378385 | B | 8/2018 |
| WO | 9005406 | A1 | 5/1990 |
| WO | 9834242 | A1 | 8/1998 |
| WO | 2010119324 | A2 | 10/2010 |

* cited by examiner

PRIOR ART

FIRST PHASE

SECOND PHASE

FIRST PHASE

SECOND PHASE

FIRST PHASE

SECOND PHASE

MULTI-PHASE IRON-CORE REACTOR HAVING FUNCTION OF CHANGING MAGNITUDE OF INDUCTANCE

This application is a new U.S. patent application that claims benefit of JP 2017-014098 filed on Jan. 30, 2017, the content of 2017-014098 is incorporated herein by reference.

BACKGROUND OF THE INVENTION

1. Field of the Invention

The present invention relates to a multi-phase iron-core reactor, and specifically relates to a multi-phase iron-core reactor having the function of changing the magnitude of inductance.

2. Description of Related Art

The inductance of reactors is designed using the number of turns of a winding, the cross-sectional area (face width× lamination length) of an iron core (core lamination structure), and a gap, as parameters.

For the purpose of adjusting the magnitude of inductance of reactors, there are reported reactors having a gap formed therein (for example, Japanese Unexamined Patent Publication (Kokai) Nos. 2013-074084 and 2007-300700). FIG. 1 is a plan view of a conventional reactor. A conventional reactor 1000 includes an approximately cylindrical outer iron core 300, and an inner iron core 400 that is formed separately from the outer iron core 300 and disposed inside the outer iron core 300. Three-phase windings 200 are independently wound on the outer iron core 300.

A support member 600, which is made of a non-magnetic sheet formed in a cylindrical shape, is disposed between the outer iron core 300 and the inner iron core 400. Disposing the support member 600 forms a gap of a uniform width between the outer iron core 300 and the inner iron core 400. The provision of the gap adjusts the amounts of magnetic fluxes Φ2 to Φ4, and hence makes an adjustment to an inductance value.

In the above conventional art, when the magnitude of inductance is adjusted with the size of the gap, a plurality of types of support members have to be prepared and replaced. When the magnitude of inductance is adjusted with the number of turns of the windings and the cross-sectional area of the iron core, a plurality of types of components having a variety of shapes, lamination lengths, etc., have to be prepared, thus causing an increase in the types of the components (windings and cores).

SUMMARY OF THE INVENTION

The present invention aims at providing a reactor that can adjust the magnitude of inductance without replacing any components.

A multi-phase iron-core reactor according to an embodiment of this disclosure has an iron core and windings. The iron core includes an outer iron core and an inner iron core. The outer iron core has teeth on which the N-phase windings are wound. The inner iron core faces the teeth through gaps, and has a shape so as to be able to provide at least two gap sizes in a selective manner.

BRIEF DESCRIPTION OF THE DRAWINGS

The objects, features and advantages of the present invention will become more apparent from the following description of embodiments along with accompanying drawings. In the accompanying drawings.

DETAILED DESCRIPTION OF THE INVENTION

A multi-phase iron-core reactor according to the present invention will be described below with reference to the drawings.

Figure 1:
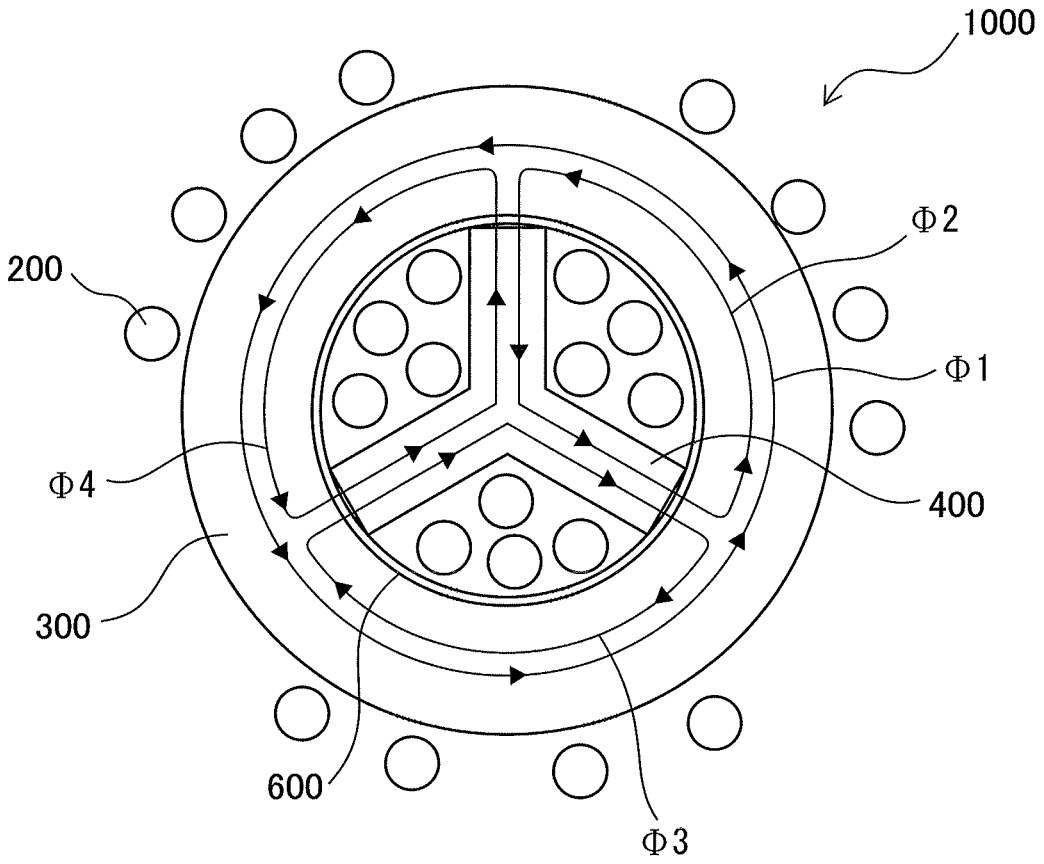
FIG. 1 is a plan view of a conventional reactor.
Figure 2:
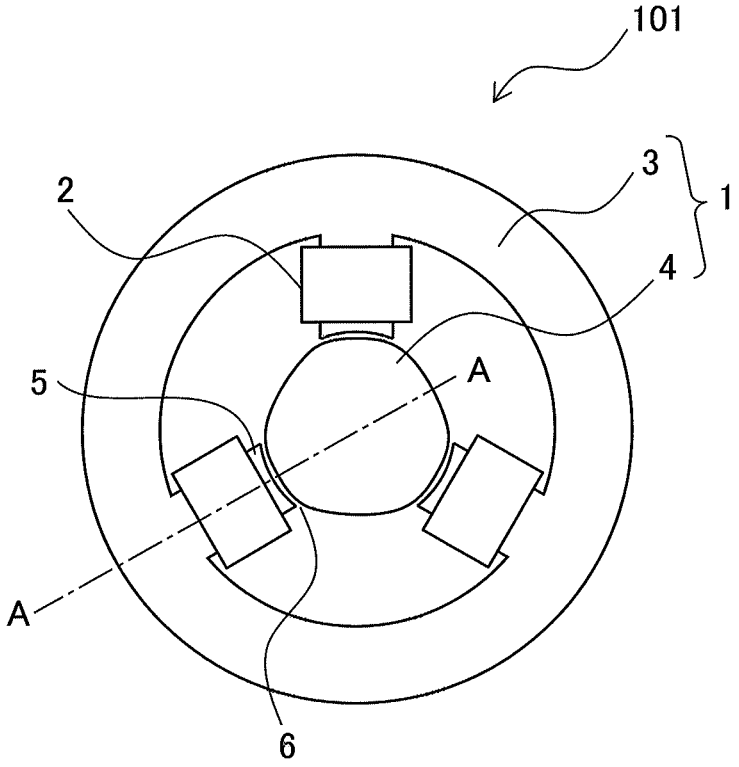
FIG. 2 is a plan view of a multi-phase iron-core reactor according to a first embodiment.

A multi-phase iron-core reactor according to a first embodiment will be described. FIG. 2 is a plan view of the multi-phase iron-core reactor according to the first embodiment. A multi-phase iron-core reactor 101 according to the first embodiment has an iron core 1 and windings 2. The iron core 1 includes an outer iron core 3 and an inner iron core 4.

The outer iron core 3 has teeth 5 on which the N-phase windings 2 are wound. In the case of three-phase, as shown in FIG. 2, an R-phase winding and tooth, an S-phase winding and tooth, and a T-phase winding and tooth, i.e., three windings 2 and teeth 5, are provided in total. However, the number of phases is not limited to three, and may be two, four or more than four. In the case of the three-phase (N=3), the teeth 5 are arranged 120° out of phase with each other with respect to a central axis of the outer iron core 3. The outer iron core 3 is cylindrical in shape. However, the outer iron core 3 may have an angular tubular shape, such as a triangular tubular shape and a hexagonal tubular shape. The teeth 5 extend in the central axis direction, and have approximately the same length as the outer iron core 3 in the central axis direction.

Figure 3:
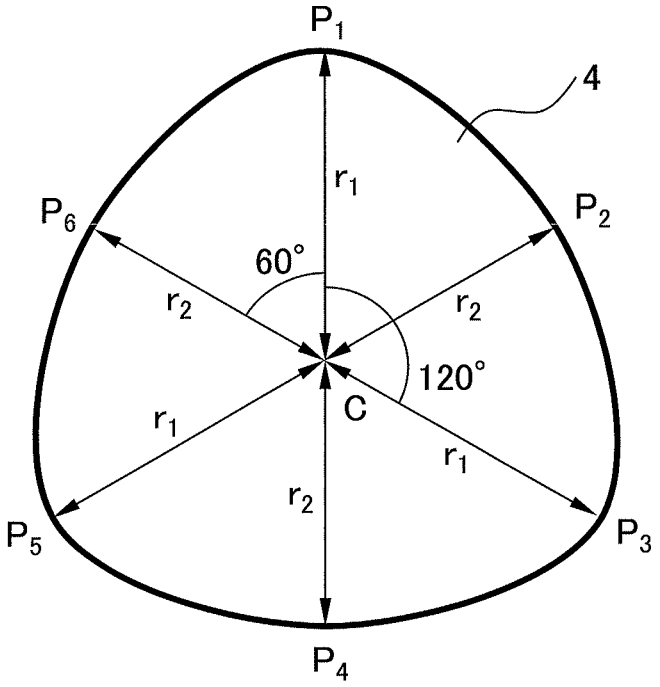
FIG. 3 is a plan view showing an example of the structure of an inner iron core constituting the multi-phase iron-core reactor according to the first embodiment.

The inner iron core 4 faces the teeth 5 through the gaps 6, and has a shape so as to be able to provide at least two sizes of the gaps 6 in a selective manner. FIG. 3 is a plan view showing an example of the structure of the inner iron core provided in the multi-phase iron-core reactor according to the first embodiment. A point $P_1$ is situated on the outer periphery of the inner iron core 4, and points $P_2$ to $P_6$ are situated 60° out of phase with each other about the center C. When $r_1$ represents the length of a straight line connecting between the center C and each of $P_1$, $P_3$ and $P_5$, and $r_2$ represents the length of a straight line connecting between the center C and each of $P_2$, $P_4$ and $P_6$, $r_1 \neq r_2$ holds true. In the example of FIG. 3, $r_1 > r_2$ holds true. In FIG. 3, the configuration illustrated in FIG. 3 is referred to as a "first phase", while the configuration in which the inner iron core 4 is turned by 60° is referred to as a "second phase". In the first phase, the inner iron core 4 faces the teeth 5 in the vicinities of $P_1$, $P_3$ and $P_5$ (see FIG. 2). In the second phase, the inner iron core 4 faces the teeth 5 in the vicinities of $P_2$, $P_4$ and $P_6$ (see FIG. 2).

The inner iron core 4 is preferably 360/N-degree symmetrical in shape. In the case of the three-phase (N=3), the inner iron core 4 is 120° symmetrical in shape. The inner iron core 4 is preferably rotatable about the central axis.

Figure 4B:
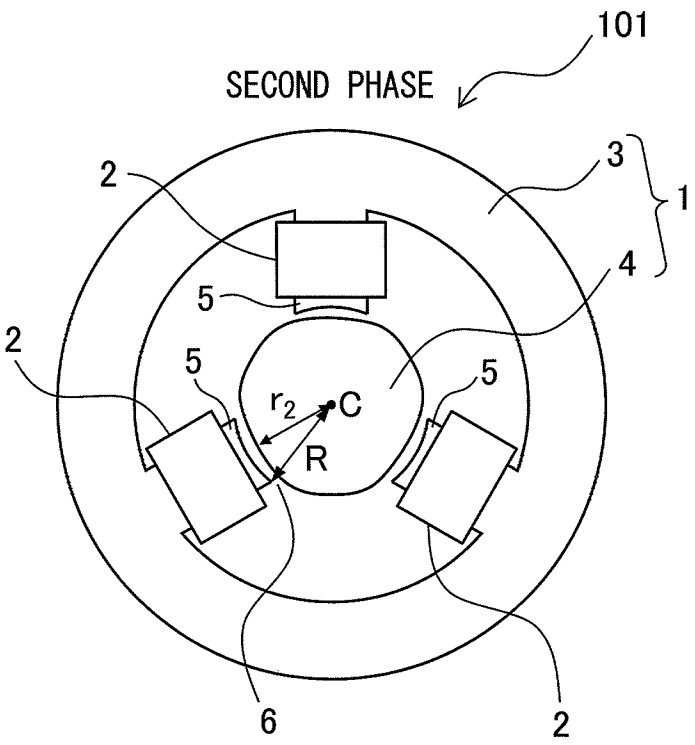
FIG. 4B is a plan view showing the structure of the multi-phase iron-core reactor in a second phase according to the first embodiment.
Figure 4A:
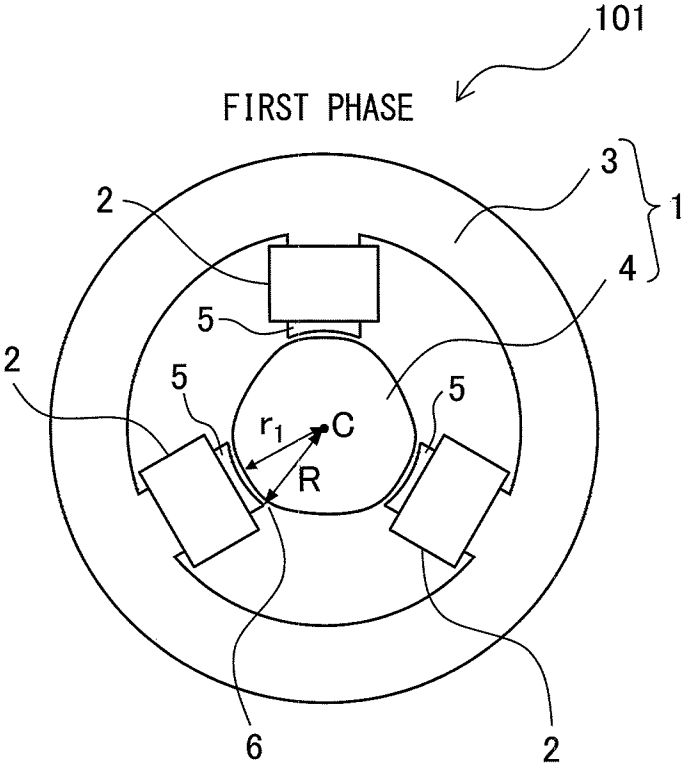
FIG. 4A is a plan view showing the structure of the multi-phase iron-core reactor in a first phase according to the first embodiment.
Figure 5A:
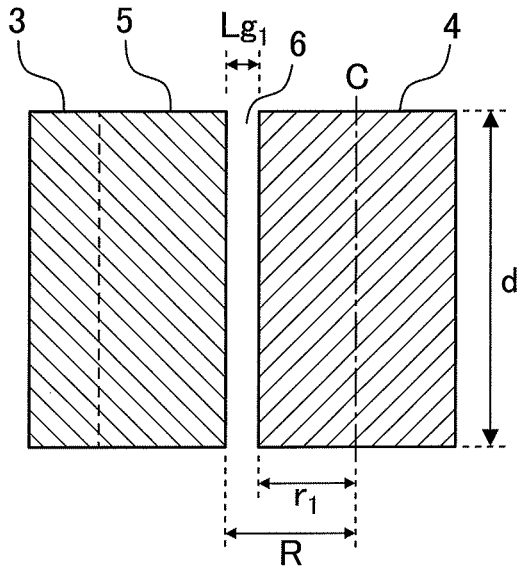
FIG. 5A is a sectional view showing the structure of the multi-phase iron-core reactor in the first phase according to the first embodiment.
Figure 5B:
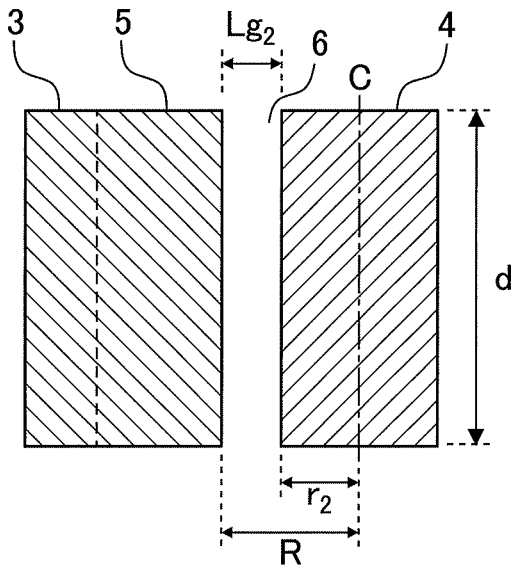
FIG. 5B is a sectional view showing the structure of the multi-phase iron-core reactor in the second phase according to the first embodiment.

FIGS. 4A and 4B are plan views of the multi-phase iron-core reactor in the first phase and the second phase, respectively, according to the first embodiment. FIGS. 5A and 5B are sectional views of the multi-phase iron-core reactor in the first phase and the second phase, respectively, that show cross sections taken on line A-A of FIG. 2, according to the first embodiment. FIGS. 4A and 5A show the structure in the first phase, while FIGS. 4B and 5B show the structure in the second phase. Here, both of the outer iron core 3 and the inner iron core 4 are centered on C. "R" represents the distance between the center C and the tooth 5. Both of the outer iron core 3 and the inner iron core 4 have a length "d" in the central axis direction.

In the first phase, since the length between the center C and the outer periphery of the inner iron core 4 is $r_1$, the size $Lg_1$ of the gap 6 is $R-r_1$. In the second phase, since the length between the center C and the outer periphery of the inner iron core 4 is $r_2$, the size $Lg_2$ of the gap 6 is $R-r_2$. Since $r_1$ is larger than $r_2$, $r_1 \neq r_2$ holds true. Therefore, $Lg_1$ ($=R-r_1$) is not equal to $Lg_2$ ($=R-r_2$) and $Lg_1 \neq Lg_2$ holds true. Since the magnitude of inductance changes depending on the size of the gaps, changing the orientation of the inner iron core 4 from the first phase to the second phase makes an adjustment to the magnitude of inductance. The three gaps 6 are formed in the three-phase reactor, and the sizes of the three gaps are preferably the same.

The inner iron core 4 is preferably rotatable about the central axis. Providing the rotatable inner iron core 4 facilitates changing the size of the gaps and thereby making an adjustment to the magnitude of inductance by only rotating the inner iron core 4.

Figure 6:
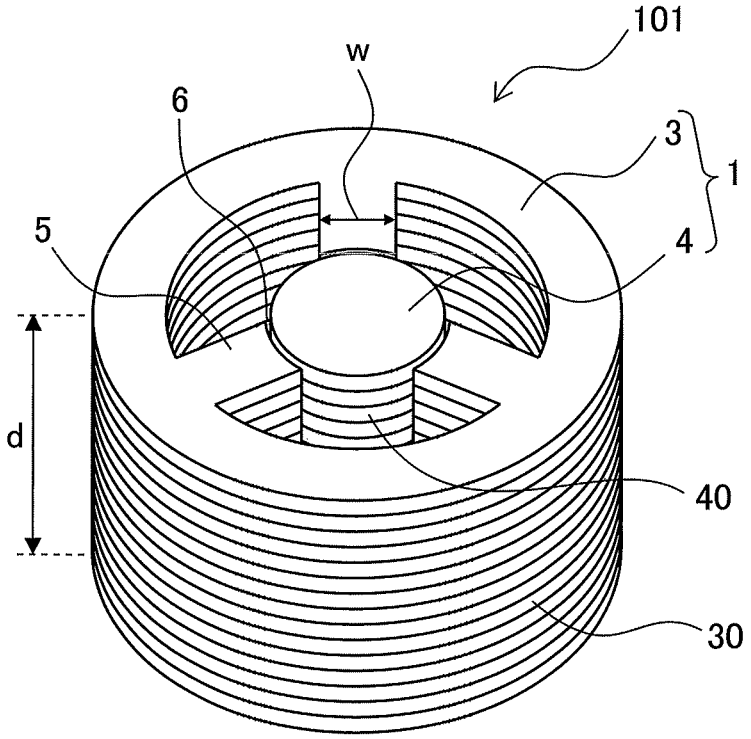
FIG. 6 is a perspective view of the multi-phase iron-core reactor according to the first embodiment.

FIG. 6 is a perspective view of the multi-phase iron-core reactor according to the first embodiment. FIG. 6 omits the windings. The outer iron core 3 may be constituted of a lamination of outer cores 30, which are made of polygonal electrical steel sheets. The inner iron core 4 may be constituted of a lamination of inner cores 40, which are made of electrical steel sheets.

Figure 7:
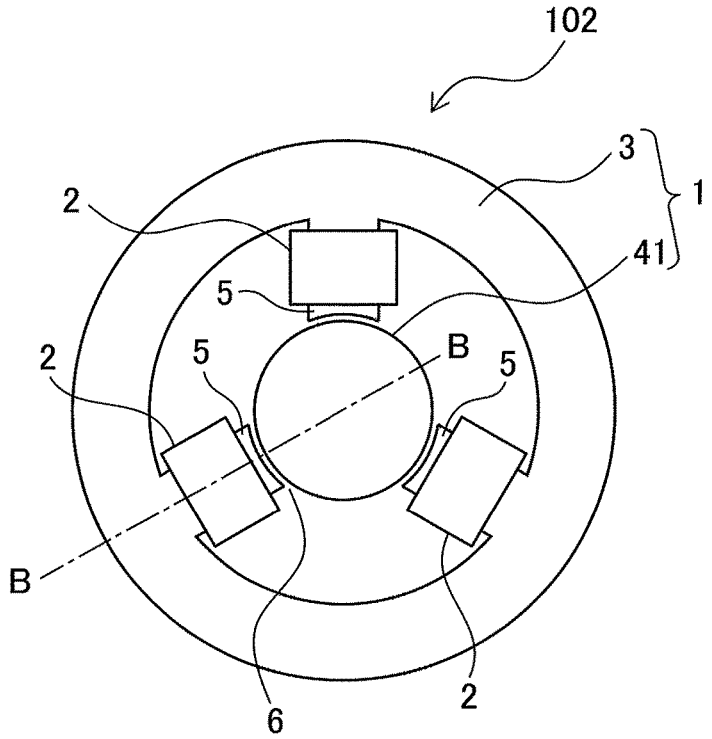
FIG. 7 is a plan view of a multi-phase iron-core reactor according to a second embodiment.

Next, a multi-phase iron-core reactor according to a second embodiment will be described. FIG. 7 is a plan view of the multi-phase iron-core reactor according to the second embodiment. The difference between a multi-phase iron-core reactor 102 according to the second embodiment and the multi-phase iron-core reactor 101 according to the first embodiment is that an inner iron core 41, which faces the teeth 5 through the gaps 6, has a shape so as to be able to provide at least two sizes of areas of the inner iron core 41 facing the teeth 5 in a selective manner. The other structures of the multi-phase iron-core reactor 102 according to the second embodiment are the same as that of the multi-phase iron-core reactor 101 according to the first embodiment, so a detailed description thereof is omitted.

Figure 8A:
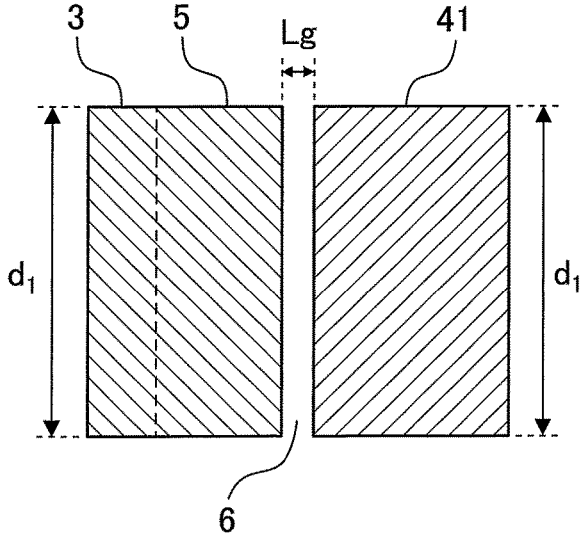
FIG. 8A is a sectional view showing the structure of the multi-phase iron-core reactor in the first phase according to the second embodiment.
Figure 8B:
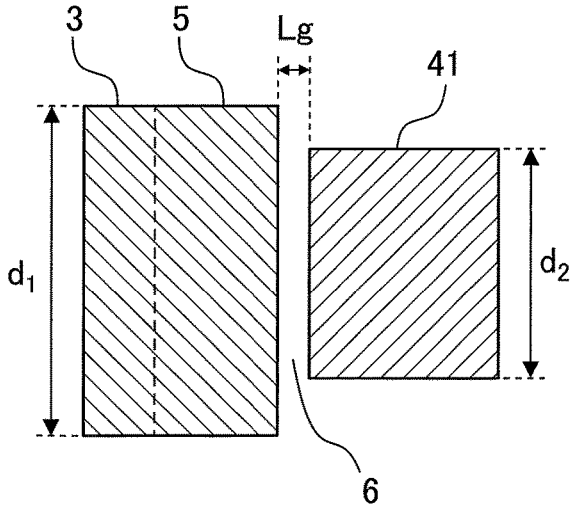
FIG. 8B is a sectional view showing the structure of the multi-phase iron-core reactor in the second phase according to the second embodiment.

FIGS. 8A and 8B are sectional views of the multi-phase iron-core reactor in the first phase and the second phase, respectively, that show cross sections taken on line B-B of FIG. 7, according to the second embodiment. FIG. 8A shows the structure in the first phase, while FIG. 8B shows structure in the second phase. In both of the first phase and the second phase, the size of the gap is invariable, i.e., Lg.

As shown in FIGS. 8A and 8B, for example, in the first phase, both of the outer iron core 3 and the inner iron core 41 have a length $d_1$ in the central axis direction. In the second phase, the length of the inner iron core 41 changes to $d_2$ in the central axis direction. As shown in FIG. 6, when w represents the width of the tooth 5, the size S of an area of the inner iron core 41 facing the tooth 5 is $S_1=w \times d_1$ in the first phase, and is $S_2=w \times d_2$ in the second phase. Since $d_1$ is not equal to $d_2$, $d_1 \neq d_2$ holds true. Therefore, $S_1$ ($=w \times d_1$) is not equal to $S_2$ ($=w \times d_2$) and $S_1 \neq S_2$ holds true. By changing the length of the inner iron core 41 in the central axis direction between the first phase and the second phase, the size S changes and the effective size of the gap changes. As a result, changing the orientation of the inner iron core 41 between the first phase and the second phase serves to change the magnitude of inductance. The size of the gap between the tooth 5 and the inner iron core 41 is invariably Lg in the example of FIGS. 8A and 8B, but may be changed between the first phase and the second phase.

Figure 9:
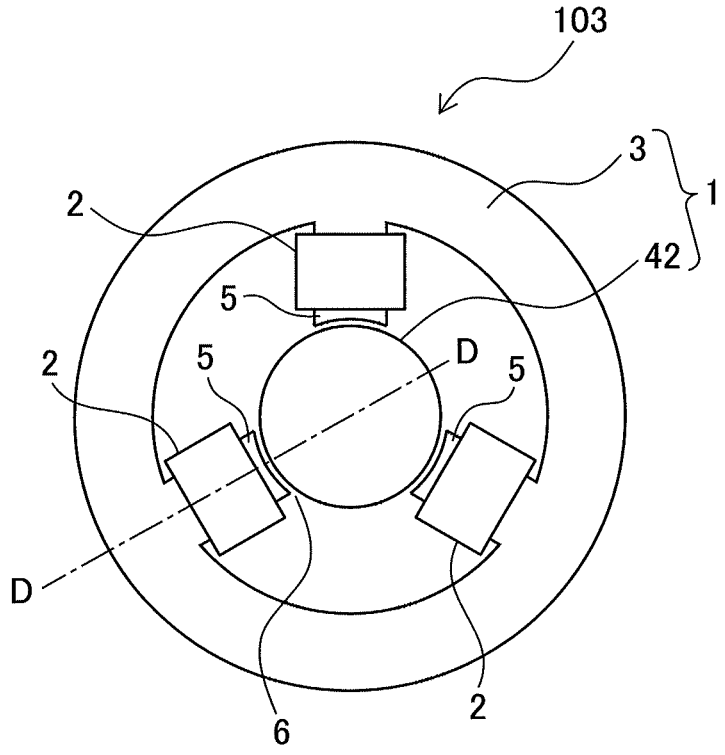
FIG. 9 is a plan view of a multi-phase iron-core reactor according to a third embodiment.

Next, a multi-phase iron-core reactor according to a third embodiment will be described. FIG. 9 is a plan view of the multi-phase iron-core reactor according to the third embodiment. The difference between a multi-phase iron-core reactor 103 according to the third embodiment and the multi-phase iron-core reactor 101 according to the first embodiment is that an inner iron core 42 has a plurality of regions to change the size of the gap 6. The other structures of the multi-phase iron-core reactor 103 according to the third embodiment are the same as that of the multi-phase iron-core reactor 101 according to the first embodiment, so a detailed description thereof is omitted.

Figure 10A:
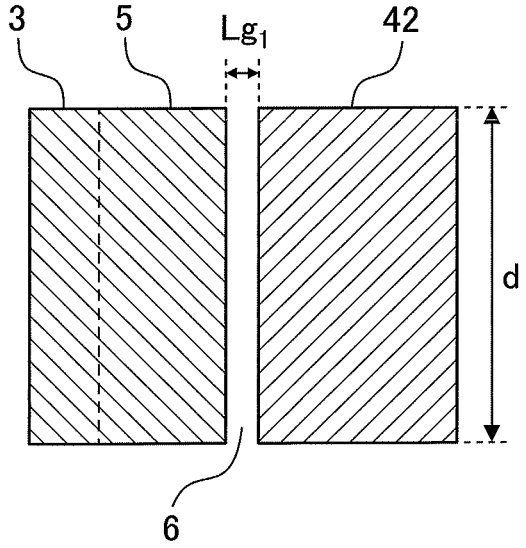
FIG. 10A is a sectional view showing the structure of the multi-phase iron-core reactor in the first phase according to the third embodiment.
Figure 10B:
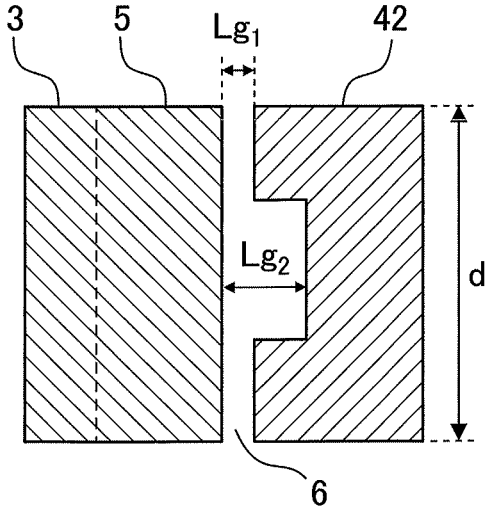
FIG. 10B is a sectional view showing the structure of the multi-phase iron-core reactor in the second phase according to the third embodiment.

FIGS. 10A and 10B are sectional views of the multi-phase iron-core reactor in the first phase and the second phase, respectively, that show cross sections taken on line D-D of FIG. 9, according to the third embodiment. FIG. 10A shows the structure in the first phase, while FIG. 10B shows the structure in the second phase. Here, both of outer iron core 3 and the inner iron core 42 have an invariable length d in the central axis direction.

As shown in FIGS. 10A and 10B, for example, in the first phase, the entire gap 6 has a size $Lg_1$. In the second phase, the gap 6 has a size $Lg_1$ in a part of an area in which the inner iron core 42 is opposed to the tooth 5, while the gap 6 has a size $Lg_2$ in the other part of the area. When $Lg_1<Lg_2$, the effective size $Lg_{eff}$ of the gap 6 satisfies $Lg_1<Lg_{eff}<Lg_2$ in the second phase. Therefore, it is possible to establish the effective size of the gap more precisely, and therefore make a fine adjustment to the magnitude of inductance, by adjusting the region of the area to change the size of the gap 6 between the second phase and the first phase. In FIGS. 10A and 10B, the distance between the tooth 5 and the inner iron core 4 is partly $Lg_1$ in the second phase, which is the same as the size of the gap 6 in the first phase, but may be set at a different size from $Lg_1$.

Figure 11B:
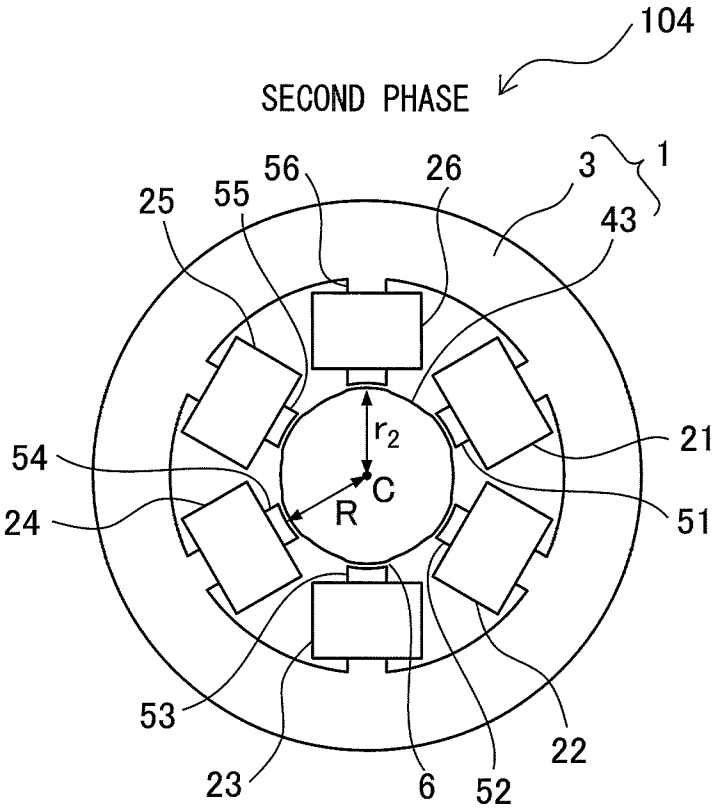
FIG. 11B is a plan view showing the structure of the multi-phase iron-core reactor in the second phase according to the fourth embodiment.
Figure 11A:
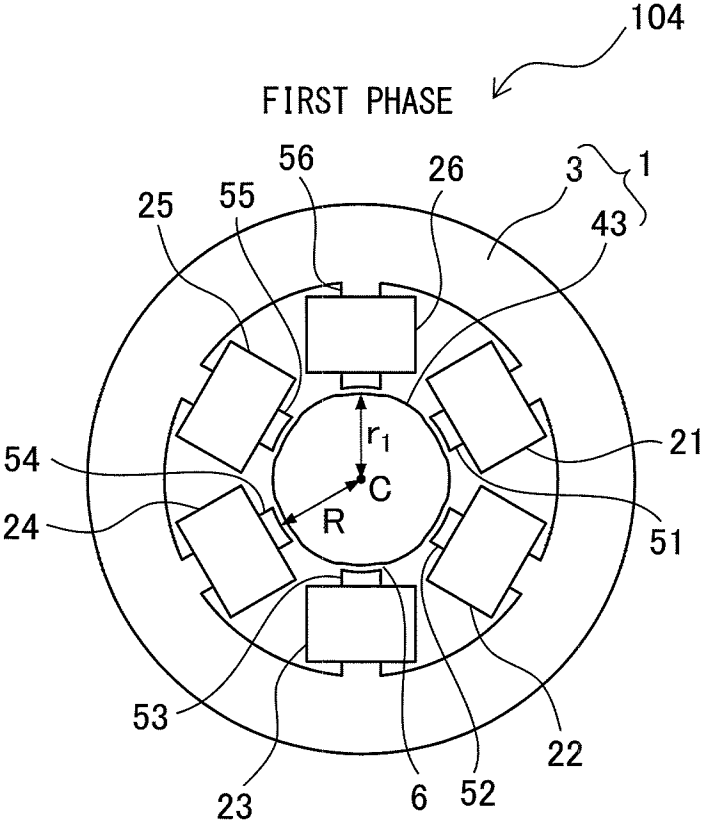
FIG. 11A is a plan view showing the structure of a multi-phase iron-core reactor in the first phase according to a fourth embodiment.
Figure 12:
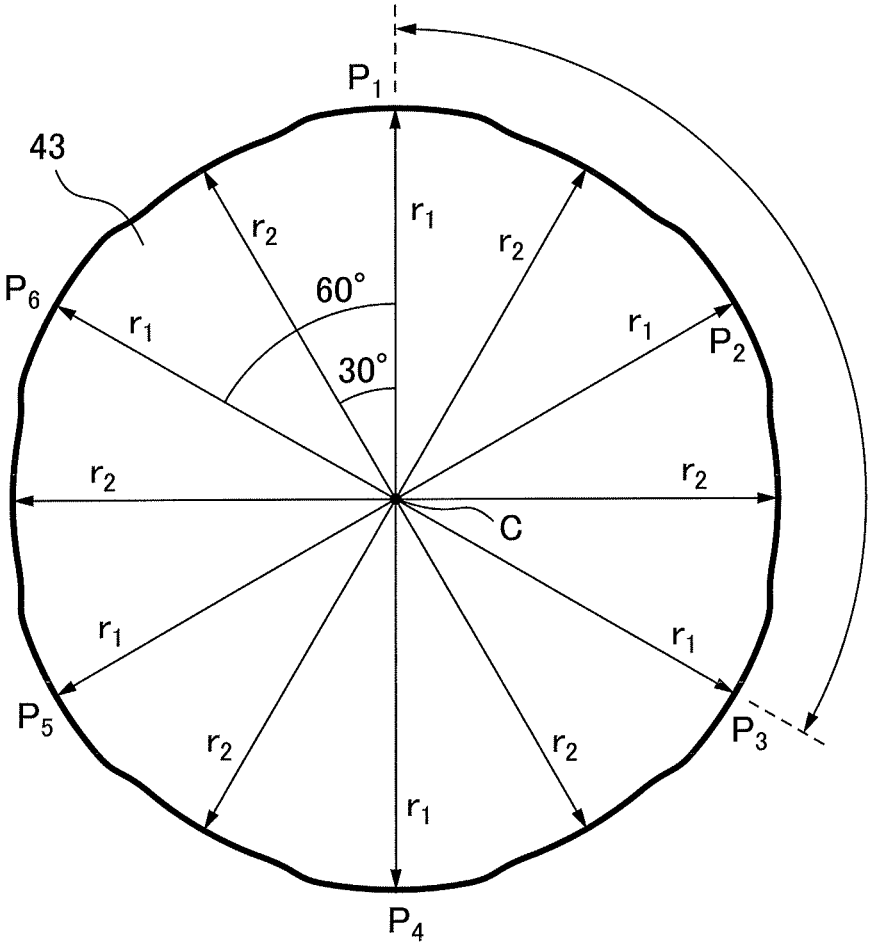
FIG. 12 is a plan view of an inner iron core constituting the multi-phase iron-core reactor according to the fourth embodiment.

Next, a multi-phase iron-core reactor according to a forth embodiment will be described. FIGS. 11A and 11B are plan views of the multi-phase iron-core reactor according to the fourth embodiment, and FIG. 12 is a plan view of an inner iron core constituting the multi-phase iron-core reactor according to the fourth embodiment. The difference between a multi-phase iron-core reactor 104 according to the fourth embodiment and the multi-phase iron-core reactor 101 according to the first embodiment is that, when M represents an integer, the tooth and winding of each phase are divided into M equal portions. The other structures of the multi-phase iron-core reactor 104 according to the fourth embodiment are the same as that of the multi-phase iron-core reactor 101 according to the first embodiment, so a detailed description thereof is omitted.

In FIGS. 11A and 11B, the R-phase winding is divided into two portions 21 and 22. The S-phase winding is divided into two portions 23 and 24. The T-phase winding is divided into two portions 25 and 26. The R-phase tooth is divided into two portions 51 and 52. The S-phase tooth is divided into two portions 53 and 54. The T-phase tooth is divided into two portions 55 and 56. When M represents an integer, the tooth and winding of each phase are preferably divided into M equal portions. FIGS. 11A and 11B show the case of M=2. However, M is not limited to this example, and may be 3 or more.

As shown in FIG. 12, an inner iron core 43 constituting the multi-phase iron-core reactor 104 according to the fourth embodiment is cylindrical in shape, and has portions having a length of $r_1$ and a length of $r_2$ between the center C and the outer periphery of the inner iron core 43. Here, since $r_1$ is not equal to $r_2$, $r_1 \neq r_2$ holds true. By way of example, the portions having the length of $r_1$ between the center C and the outer periphery of the inner iron core 43 are arranged 60° out of phase with each other in the outer periphery. The portions having the length of $r_2$ between the center C and the outer periphery of the inner iron core 43 are arranged 60° out of phase with each other in the outer periphery, and are arranged 30° out of phase with the portions having the length of $r_1$. Note that, FIG. 12 shows an example in which there are mainly two varieties of lengths between the center C and the outer periphery of the inner iron core 43, but there may be three or more varieties of lengths.

The structure of the inner iron core 43 shown in FIG. 12 corresponds to an instance in which the multi-phase iron-core reactor 104 has the three-phase windings, and M, which is the number for dividing the tooth and winding of each phase, is 2. In the instance, the portions having the length of $r_1$ between the center C and the outer periphery of the inner iron core 43 are formed at points P1 to P6, which are situated 360°/3/M, i.e., 60° out of phase with each other. Therefore, when there are N-phase windings, the length between the center C and the outer periphery of the inner iron core 43 is $r_1$ in positions 360°/N/M out of phase with each other.

FIG. 11A shows a state of the "first phase" in which the length between the center C of the inner iron core 43 and the outer periphery thereof is $r_1$ in the vicinities of portions that the teeth (51 to 56) face. At this time, since the distance between the center C of the inner iron core 43 and each of the teeth (51 to 56) is R, the size of the gap 6 is $R-r_1$. On the other hand, FIG. 11B shows a state of the "second phase" in which the length between the center C of the inner iron core 43 and the outer periphery thereof is $r_2$ in the vicinities of portions that the teeth (51 to 56) face. At this time, since the distance between the center C of the inner iron core 43 and each of the teeth (51 to 56) is R, the size of the gap 6 is $R-r_2$. Since $r_1 \neq r_2$ holds true, $(R-r_1)$ is not equal to $(R-r_2)$. Therefore, $(R-r_1) \neq (R-r_2)$ holds true. Changing the state between the first phase and the second phase changes the size of the gaps. To change the state between the first phase and the second phase, the inner iron core 43 may be turned by 30°.

In the above description, by way of example, the length between the center C of the inner iron core 43 and the outer periphery thereof can be chosen from the plurality of lengths. However, the size of the areas at which the outer periphery of the inner iron core faces the teeth may be changeable, and the magnitude of inductance may be changed by turning the inner iron core.

As described in the multi-phase iron-core reactor according to the fourth embodiment, dividing the tooth and winding into the plurality of portions serves to increase the magnitude of inductance.

According to the multi-phase iron-core reactors of the embodiments of this disclosure, it is possible to provide a reactor that can adjust the magnitude of inductance without replacing any of the components.

What is claimed is:

1. A multi-phase iron-core reactor comprising an iron core and windings, wherein the iron core includes an outer iron core and an inner iron core;

the outer iron core has three teeth on which the three-phase windings are wound, each of the three teeth extends toward a central axis of the outer iron core, the three teeth are arranged 120° out of phase with each other with respect to a center which is the central axis of the outer iron core;

the inner iron core has a first portion, which faces each of the three teeth in first phase and outwardly curves in the radial direction, and a second portion, which faces each of the three teeth in second phase, which is 60° out of phase with respect to the center which is the central axis of the outer iron core, from the first phase and outwardly curves in the radial direction so as to be different from the first portion;

the inner iron core is arranged so as to form a first gap when the first portion is opposed to each of the three teeth in the position of the first phase, and is arranged so as to form a second gap, the size of which is different from that of the first gap, when the second portion is opposed to each of the three teeth in the position of the second phase.

2. The multi-phase iron-core reactor according to claim 1, wherein the outer iron core is constituted of a lamination of outer cores made of polygonal electrical steel sheets.

3. The multi-phase iron-core reactor according to claim 1, wherein the inner iron core is constituted of a lamination of inner cores made of electrical steel sheets.

4. The multi-phase iron-core reactor according to claim 1, wherein the inner iron core is 120° symmetrical in shape with respect to the center which is the central axis of the outer iron core.

5. The multi-phase iron-core reactor according to claim 1, wherein the inner iron core is rotatable about a central axis.

6. The multi-phase iron-core reactor according to claim 1, wherein the teeth and the coil for each phase are equally divided by M, which is a whole number.

* * * * *